US005213937A

United States Patent [19]

Miyake

[11] Patent Number: 5,213,937

[45] Date of Patent: May 25, 1993

[54] PROCESS FOR PREPARING AN ELECTROPHOTOGRAPHIC PHOTORECEPTOR

[75] Inventor: Kan Miyake, Hachioji, Japan

[73] Assignee: Konica Corporation, Tokyo, Japan

[21] Appl. No.: 791,563

[22] Filed: Nov. 12, 1991

[30] Foreign Application Priority Data

Nov. 15, 1990 [JP] Japan ..... 2-309223

[51] Int. Cl.[5] ..... G03G 5/043

[52] U.S. Cl. ..... 430/130; 430/132

[58] Field of Search ..... 430/127, 130, 132

[56] References Cited

U.S. PATENT DOCUMENTS 4,252,883 2/1981 Komura et al. ..... 430/127

4,618,559 10/1986 Yashiki ..... 430/127

*Primary Examiner*—John Goodrow

*Attorney, Agent, or Firm*—Frishauf, Holtz, Goodman & Woodward

[57] ABSTRACT

A process of preparing electrophotographic photoreceptor aluminum drums having coated layers with a constant thickness and properties is disclosed. After a carrier generation layer being dip coated, a process of conveyance is followed at a temperature same as that of the coating material.

8 Claims, 3 Drawing Sheets

PROCESS FOR PREPARING AN ELECTROPHOTOGRAPHIC PHOTORECEPTOR

FIELD OF THE INVENTION

This invention relates to a process for preparing an electrophotographic photoreceptor in which a photoreceptive layer is formed on, for example, a cylindrical substratum, in a dip-coating method.

BACKGROUND OF THE INVENTION

Japanese Patent Publication Open to Public Inspection—hereinafter referred to as 'JP OPI Publication-No. 61-149272/1986', for example, has so far proposed a technique relating to the preparation of an electrophotographic photoreceptor, in which a coating solution containing a photoconductive composite is coated on a cylindrical substratum in a dip-coating method.

In the above patent publication, a substratum having one end closed and the other end opened has been used as a cylindrical substratum. When the substratum is coated by dipping it in a coating solution from its open end, the patent publication describes that it would be preferred to keep a coating room temperature $T_A$ (or the air temperature of the substratum) equivalent to or relatively little higher than a coating solution temperature $T_L$. For example, it describes that, if a substratum thickness is not thinner than 1 mm, the relation between the two temperatures is preferably $-2° C. \leqq T_A - T_L \leqq 10° C.$ and, if a substratum thickness is not thicker than 1 mm, the relation therebetween is preferably $-1° C. \leqq T_A - T_L \leqq 3° C.$ The proposal of the above patent publication paid attention to the temperature characteristics when a substratum is coated. However, post-process treatments to be made after completing a coating process are also very important from the viewpoint of preparing an electrophotographic photoreceptor.

Therefore, JP OPI Publication No. 58-207050/1983 discloses a technique for forming a photoreceptor, in which, after completing a coating process in a coating method such as a dip-coating, a spray-coating, a spin-coating, a spinner-coating or a blade-coating method by making use of an apparatus such as shown in FIG. 3, the coated substratum is then dried with hot air, so that a photoreceptor can be formed. The specification of this patent publication gives the examples of photoreceptors each comprising a photoreceptive layer having a layer structure multilayered with a carrier generation layer and a carrier transport layer. In the examples, each of the layers are dried up with hot air at a temperature of 130° C.

However, in the above-mentioned preparation processes carried out with such a hot air-drying treatment as described above, the electrophotographic characteristics are deteriorated, because a thin-coated layer such as an under layer or a carrier generation layer is so fatigued as to be deteriorated by an excess drying treatment and a heat treatment. In the case of a carrier generation layer, a coating unevenness produced in a coating process and dispersed-grain flocculates are rapidly dried-and-fixed without any spare time to deflocculate them, so that there raise the problems that any uniform image cannot be produced because of a charging unevenness and photosensitivity unevenness produced in forming an image.

SUMMARY OF THE INVENTION

This invention is proposed upon taking the above-described situations into consideration.

It is, accordingly, an object of the invention to propose a process for preparing an electrophotographic photoreceptor from which any electrophotographic characteristic defects such as charging unevennness and photosensitivity unevennes can be eliminated by making no use of hot-air drying treatment when forming a thin-layer such as a carrier generation layer and after completing a coating treatment.

BRIEF DESCRIPTION OF THE DRAWINGS

FIG. 3 is a cross-sectional view of a conventional dryer; wherein

Figure 1:
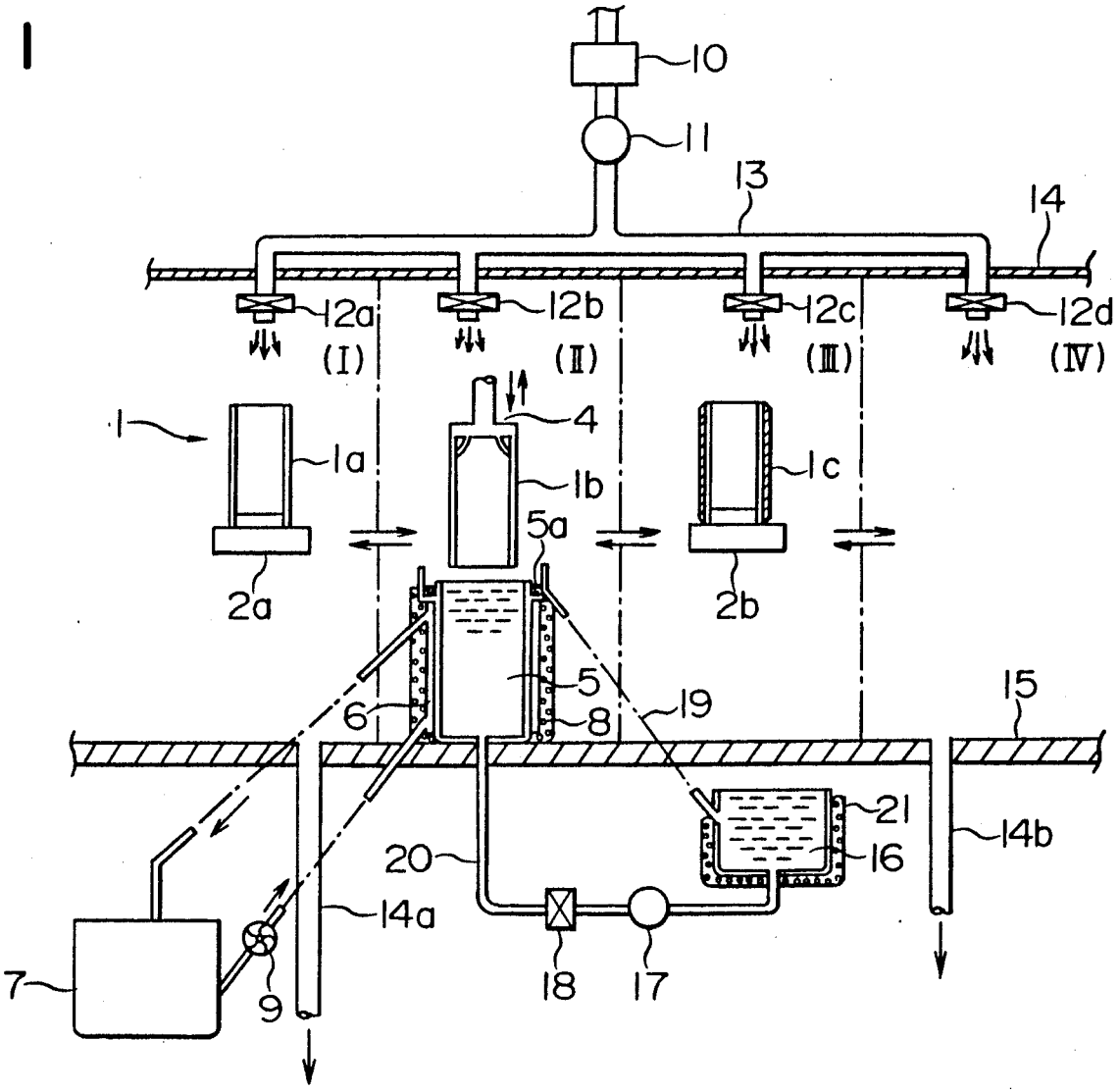
FIG. 1 illustrates the steps for processing a carrier generation layer.

1*a*, 1*b*, 1*c* . . . Substratum;
2*a*, 2*b* . . . Support carrier tables;
4 . . . DRUM SUPPORT CHUCK;
5 . . . Coating solution tank;
7 . . . Thermostat water tank;
12*a*, 12*b*, 12*c*, 12*d* . . . AIR FILTER;
16 . . . Coating replenisher tank;
18 . . . FILTER FOR Coating Solution

DETAILED DESCRIPTION OF THE INVENTION

The aforementioned objects of the invention can be achieved with a process for preparing an electrophotographic photoreceptor comprising a step of forming plural coated layers containing a carrier generation layer on a substratum, wherein at least the above-mentioned carrier generation layer is formed on the substratum in the manner that, after the substratum is dipped and the carrier generation layer is coated thereon, the layer-coated substratum is passed through a transport step having almost the same temperature as that of the coating solution.

In the preferable embodiments of the preparation processes of the invention, it is preferred to form a carrier generation layer in the manner that, after the foregoing substratum is dipped in a coating solution being kept at a temperature lower than 30° C. and at least a carrier generation layer is then coated thereon so as to have a wet-layer thickness within the range of 5 to 50 μm, the resulting layer-coated substratum is passed through a transport step having a temperature of the coating solution temperature ±5° C. for a period within the range of 1 to 20 minutes and, particularly that, after the foregoing substratum is dipped in a coating solution being kept at a temperature not higher than 27° C. and the carrier generation layer is then coated thereon, the resulting layer-coated substratum is passed through a transport step having a temperature of the coating solution temperature ±2° C.

It is usual in the preparation processes of the invention that an under layer is provided, if required, onto a cylindrical substratum, and a carrier generation layer and a carrier transport layer are then coated thereon. If further required, a protective layer may be provided thereon.

The above-mentioned cylindrical substrata include, for example; a conductive substratum vapor-deposited on a plastic cylinder surface with a metal or provided thereon with a carbon-black resin layer; and a substratum made of a metal such as aluminium, copper, steel, stainless steel, pyrites and brass. The particularly preferable include, for example an aluminium-made cylinder having a thickness within the range of 0.5 to 3.0 mm. The under layer which may be used if required is to have both functions, namely, a barrier function and an adhesion function of a substratum to a photoreceptive layer. The under layer include, for example, a thin layer having a thickness within the range of 0.1 to 5.0 μm and mainly comprising a macromolecular compound such as casein, polyvinyl alcohol, ethyl cellulose, carboxymethyl cellulose, nitrocellulose, an ethylene-acrylic acid copolymer, an ethylene-vinyl acetate copolymer, a vinyl chloride-vinyl acetate-maleic anhydride copolymer and Nylon.

The above-mentioned under layer is so coated as to have a wet-thickness within the range of 1 to 50 μm onto a cylindrical substratum having been cleaned in advance by washing it well with a solvent such as dichloroethylene, trichloroethylene and chloroform in the following manner. The cleaned substratum is dipped in an under layer-coating solution having been prepared in advance by dissolving the aforementioned macromolecular compounds into an alcohol type solvent such as methanol, ethanol and isopropanol or a ketone type solvent such as acetone and methylethyl ketone and being kept at a temperature lower than 30° C. and preferably at a temperature not higher than 27° C. so that the substratum can be so coated as to have the above-mentioned wet-thickness. The dip-coating step is performed under the specific clean-air atmospheric conditions of a coating solution temperature of ±5° C. and preferably ±2° C. and under the atmospheric conditions of a cleanness degree of not higher than 100. After completing the coating treatment, the coated substratum is transported through the above-mentioned clean-air atmospheric conditions for a period within the range of 1 to 20 minutes and is then followed into the successive step of coating a carrier generation layer.

The above-mentioned under layer may be dried up at a relatively little higher temperature within the range of 30° C. to 60° C. if occasion requires.

A carrier generation layer is provided, onto the above-mentioned under layer, so as to be a thin layer having a thickness within the range of 0.1 to 2 μm which is prepared by dipping a substratum coated thereon with the under layer into a coating solution comprising, for example, a resin dispersed solution containing an inorganic pigment such as photoconductive zinc oxide and cadmium sulfide, a resin dispersed solution containing an organic pigment such as a phthalocyanine type pigment, a polycyclic quinone type pigment, a perylene pigment, an azo type pigment and a quinacridone type pigment and, besides the above, a solution dispersed therein with an eutectic complex of a pyrylium salt type dye and polycarbonate.

The above-mentioned carrier generation layer can be prepared in the following manner. A substratum having thereon an under layer is dipped in a coating solution being kept at a temperature lower than 30° C. and preferably not higher than 27° C. under the foregoing specific clean-air atmospheric conditions and it is successively transported through the above-mentioned clean-air atmosphere for a period within the range of 1 to 20 minutes. In the case of a carrier generation layer, it is inevitable requirement that the carrier generation layer should be transported through the above-mentioned clean-air atmosphere after it was coated.

The reason why the above-mentioned transportation should be inevitable is that dispersed grains, i.e., carrier generation substances, are liable to flocculate in a coating solution layer in a coating step. Therefore, when the above-mentioned coating solution layer is passed through an atomosphere having a temperature nearly the same as the temperature of the coating solution, after completing the coating step, the flocculation is dispersed to be deflocculated, so that a photoreceptor without having any charging unevennes and photosensitivity unevenness; can be obtained.

The coating solution is preferable to be kept at a temperature lower than 30° C. and, particularly, within the range of 27° C. to 5° C. If the temperature of the coating solution is not lower than 30° C., the liquid thickness of the upper portion becomes different from that of the lower portion thereof, that is not desirable, because, when a substratum is pulling up from a coating solution after it was dipped therein, the coating solution is flowed down rapidly. In the case of a carrier generation layer, it is attended by such an ill effect that dispersed grains are liable to flocculate. From the above-mentioned viewpoints, the coating solution temperature is preferably kept at 27° C. or lower. When the temperature thereof is lower than 5° C., the solution temperature is too low to obtain any uniformly coated layer. It is also preferable that a clean-air temperature is to be nearly the same as a coating solution temperature and, if there is a big difference between the two temperatures, it is also not desirable because bubbles are so produced as to derive a coating unevenness therefrom or a backstain is produced by a solution which invades inside of a cylindrical substratum.

From the reasons mentioned above, the clean-air temperature is to be within the range of a coating solution temperature ±5° C. and, preferably, a coating solution temperature ±2° C.

The cleanness degrees of the clean-air are to be preferably not higher than 100. If the cleaness degrees exceed 100, it is not desirable because spots are produced. The cleaness degrees of clean-air can be measured in the following manner.

The cleanness degrees of the clean-air are expressed by the number of dust grains contained in a $ft^3$ and they are measure by a dust-counter, Model KC-01B manufactured by Rion Co.

The number of the above-mentioned dust grains can be measured by specifying the grain sizes, namely, not smaller than 0.1 μm, not smaller than 0.3μm and not smaller than 0.5 μm. In the invention, the cleannes degrees are measured by the numbers of the above-mentioned dust grains each having the grain sizes not smaller than 0.5 μm.

The wet layer thickness L resulted by the above-mentioned dipping and coating operations can be calculated out of the following formula into which a dried layer thickness d (μm) of each layer and the formula of a coating solution are applied.

$$L = d \times \frac{\text{Weight of a coating solution used}}{\text{Weight of coating solution used} - \text{weight of solvent a used}}$$

In the above-mentioned carrier generation layer, the binder resins capable of dispersing carrier generation substances may each be selected from a wide range of insulating resins, namely, an organic photoconductive polymers such as poly-N-vinyl carbazole, polyvinyl anthracene and polyvinyl pyrene and, preferably, an insulating resin such as polystyrene, polyvinyl butyral, polyacrylate (e.g., a condensed polymer of bisphenol A and phthalic acid), polycarbonate, polyester, phenoxy resin, polyvinyl acetate, acrylic resin, polyacrylamide resin, polyamide, polyvinyl pyridine, a cellulose type resin, urethane resin, epoxy resin, casein, polyvinyl alcohol and polyvinyl pyrrolidone.

The organic solvents applicable to prepare a coating solution include, for example, the following compounds;

Alcohols such as methanol, ethanol and isopropanol; ketones such as acetone, methylethyl ketone and cyclohexanone; amides such as N,N-dimethyl formamide and N,N-dimethyl acetamide; sulfoxides such as dimethyl sulfoxide; ethers such as tetrahydrofran, dioxane and ethylene glycol monomethyl ether; esters such as methyl acetate and ethyl acetate; aliphatic halogenohydrocarbons such as chloroform, methylene chloride, dichlorethylene, carbon tetrachloride and trichlorethylene; or aromatic compounds such as benzene, toluene, xylene, ligroin, monochlorobenzene and dichlorobenzene.

Next, a carrier transport layer to be formed on the above-mentioned carrier generation layer can be formed in the following manner. A substratum having thereon the foregoing under layer and carrier generation layer is dipped in and then coated thereon with a coating solution comprising a resin solution containing the following carrier transport substances, and finally dried. The carrier transport substances include, for example, an oxazole derivative, an oxadiazole derivative, a thiazole derivative, a thiadiazole derivative, a triazole derivative, an imidazole derivative, an imidazolone derivative, an imidazolidine derivative, a bisimidazolidine derivative, a styryl compound, a hydrazone compound, a pyrazoline derivative, an amine derivative, an oxazolone derivative, a benzothiazole derivative, a benzimidazole derivative, a quinazoline derivative, a benzfran derivative, an acridine derivative, a phenadine derivative, an aminostilbene derivative, poly-N-vinyl carbazole, poly-1-vinyl pyrene and poly-9-vinyl anthracene.

The above-mentioned carrier transport layer is dipped in a clean-air atmosphere as same as in the cases of the under layer and the carrier generation layer and is then so coated as to have a wet-layer thickness within the range of 50 to 100 μm and, thereafter, it is dried up in a hot-air atmosphere having a temperature within the range of 80° to 150° C. for a period within the range of 30 to 90 minutes. Thereby, a photoreceptor comprising a laminated photoreceptive layer having a finished layer thickness within the range of 10 to 30 μm and preferably 15 to 25 μm can be prepared.

As for the binder resins applicable to the above-mentioned carrier transport layer coating solution, the resins similar to those applicable to the foregoing carrier generation layer can be used. However, the resins compatible to the applicable carrier transport substances are to be selected out. As for the solvents applicable to the carrier transport layer, the solvents applicable to the foregoing carrier generation layer may be appropriated thereto. However, the solvents capable of dissolving the above-mentioned carrier transport substances and the binder resins thereof are to be used.

Further, a protective layer having a layer thickness within the range of 0.01 to 1.0 μm may be arranged over to the foregoing support, if required. If this is the case, it is usually desirable to produce the protective layer, in the same manner as in the foregoing under layer formation, by dipping and coating it in the clean-air atmosphere and then by passing it through the transport step under the same clean-air atmosphere.

FIG. 1 shows an example of the coating.transporting step carried out in a method of dipping.coating a cylindrical substratum in a carrier generation layer coating solution. In the figure, (I) shows the step for pretreating a carrier generation layer which is not yet coated, that is, the step for washing.drying substratum Ia or for coating transporting (or drying) an under layer; (II) shows the step for coating the carrier generation layer; (III) shows the step for transporting the carrier generation layer which was already coated; and (IV) shows the successive step for processing a carrier transport layer. Substratum I is transported by, for example, a robot, between each of the steps while supporting it on support.transport tables 2*a* and 2*b*. To each of the steps, the clean-air is introduced through duct 13 equipped with air-conditioner 10, fan 11 and each of filters 12*a*, 12*b*, 12*c* and 12*d*. The clean-air with a solvent is exhausted from ducts 14*a* and 14*b* and, at this time, each of the steps is retained on the clean-air pressure side so that any dusts invading from outside can be prevented. In this figure, a cylindrical substratum having both of the opened ends is shown, in which a coating solution is coated on the substratum in the following manner. The substratum is transported as shown by 1*b* from the preceding step (I) into the step (II) for coating a carrier generation layer while being supported on transport table 2*a* and is then retained by DRUM SUPPORT CHUCK 4 hung from ceiling 14 so as to be lifted up once while keeping one of the open ends closed. Then, after returning transport table 2*a* back to step (I), the substratum is dipped in coating solution tank 5, so that the coating solution can be coated thereon. The coating solution stored in the coating solution tank is kept at a specific temperature by heat-retaining water circulated by pump 9 from thermostat water tank 7 to the space between solution tank 5 and outer wall 6 thereof, and outer wall 6 of solution tank 5 is kept at a constant temperature by heat-retaining jacket 8.

The coating solution stored in the above-mentioned solution tank 5 is introduced from coating solution replenisher tank 16 placed under floor 15 through coating solution transport pipe 20 attached with pump 17 and filter 18 so as to be overflowed into solution reservoir 5*a* when substratum 1*b* is dipped in solution tank 5. The overflow is collected and returned to the above-mentioned solution tank 16 through pipe 19, and solution tank 16 is kept at a specific temperature by jacket 21.

The above-mentioned substratum 1*b* is dipped in coating solution tank 5 and is then pulled up therefrom. After substratum 1*b* is released from chuck 4, it is placed on empty transport table 2*b* transported from succesive transport step (III). It is transported, in the form of substratum 1*c* retaining a carrier generation layer, into transport step (III) for a period within the range of 1 to 20 minutes and is then transported into seccessive step (IV).

The carrier generation layer has been described as an example. Also in the cases of an under layer and a protective layer each provided if required, it is preferred to use the same steps. When taking the above-described preparation steps, a photoreceptor can be prepared so as to have uniform and unscattered electrophotographic characteristics.

EXAMPLES

The invention will now be detailed with reference to the examples thereof. It is, however, to be understood that the embodiments of the invention shall not be limited thereto.

(1) Preparation of a Cylindrical Substratum

First, 12 pieces of cold-drawn aluminium-matrix pipes having the following dimensions were each surface-treated as shown in Table 1 so that 3 pieces each of 4 kinds of substrata, A1, A2, A3 and A4, totaling 12 pieces could be prepared.

TABLE 1

| Dimensions, etc. | Outer diameter (mm) | Length of pipe l (mm) | Thickness t (mm) | Surface treated | Surface roughness Rmax (mm) | Number of pipes |
|---|---|---|---|---|---|---|
| Substrata | | | | | | |
| A1 | 80.0 | 355.5 | 1.25 | Mirror-finished with a single crystal diamond bite | 0.2 | 3 |
| A2 | 80.0 | 351.0 | 1.00 | Mirror-finished with a single crystal diamond bite | 0.2 | 3 |
| A3 | 80.0 | 355.5 | 1.25 | Processed with a grindstone | 0.8 | 3 |
| A4 | 80.0 | 355.5 | 1.25 | Processed with a polycrystal diamond bite | 0.8 | 3 |

(2) Preparation of Coating Solution (2-1) Under layer coating solution

An under layer coating solution was prepared by dissolving 100 g of a vinyl chloride-vinyl acetate-maleic anhydride copolymer (Eslec MF-10 manufactured by Sekisui Chemical Co.) in 10000 ml of acetone and the resulting solution was then adjusted to have a temperature of 25° C.

(2-2) Carrier generation layer coating solution

A carrier generation layer coating solution was prepared in the following manner,

| | |
|---|---|
| A dibromoanthoanthrone pigment, (Monolite-Red 2Y manufactured by ICI) | 200 g and |
| A polycarbonate resin, (Panlite L-1250 manufactured by Teijin Chemical Co.) | 100 g |

were each dissolved and dispersed in 8700 ml of 1,2-dichlorethane and the resulting solution was then so adjusted as to have a temperature of 25° C.

(2-3) Carrier Transport Layer Coating Solution

A carrier transport layer coating solution was prepared in the following manner, A carrier transport substance having the following structure; 1160 g -continued

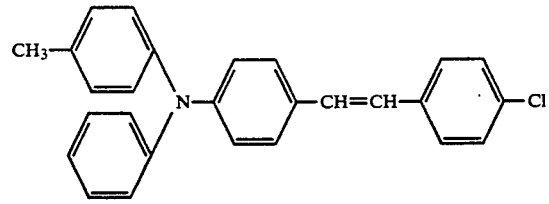

A polycarbonate resin, (Eupyrone Z-200 manufactured by Mitsubishi Gas-Chemical Co.) 15500 g were each dissolved in 7800 ml of 1,2-dichlorethane and the resulting solution was so adjusted as to have a temperature of 25° C.

(3) Preparation of Photoreceptor

The 4 kinds of substrata, A1 through A4 shown in the foregoing table 1, were each dipped in trichlorethane having a temperature of 40° C. and they were shaken and stirred by a supersonic stirrer at 28 KHz for 120 seconds. The temperatures thereof were cooled down to 25° C. and they were shaked and stirred again by the stirrer at 40 KHz for 60 seconds and then washed. Finally, they were further washed with trichlorethan vapor at 74° C. and dried up, so that 4 kind totaling 12 pieces (i.e., 3 pieces per kind) of substrata subject to photoreceptive layer coating could be obtained.

Figure 2:
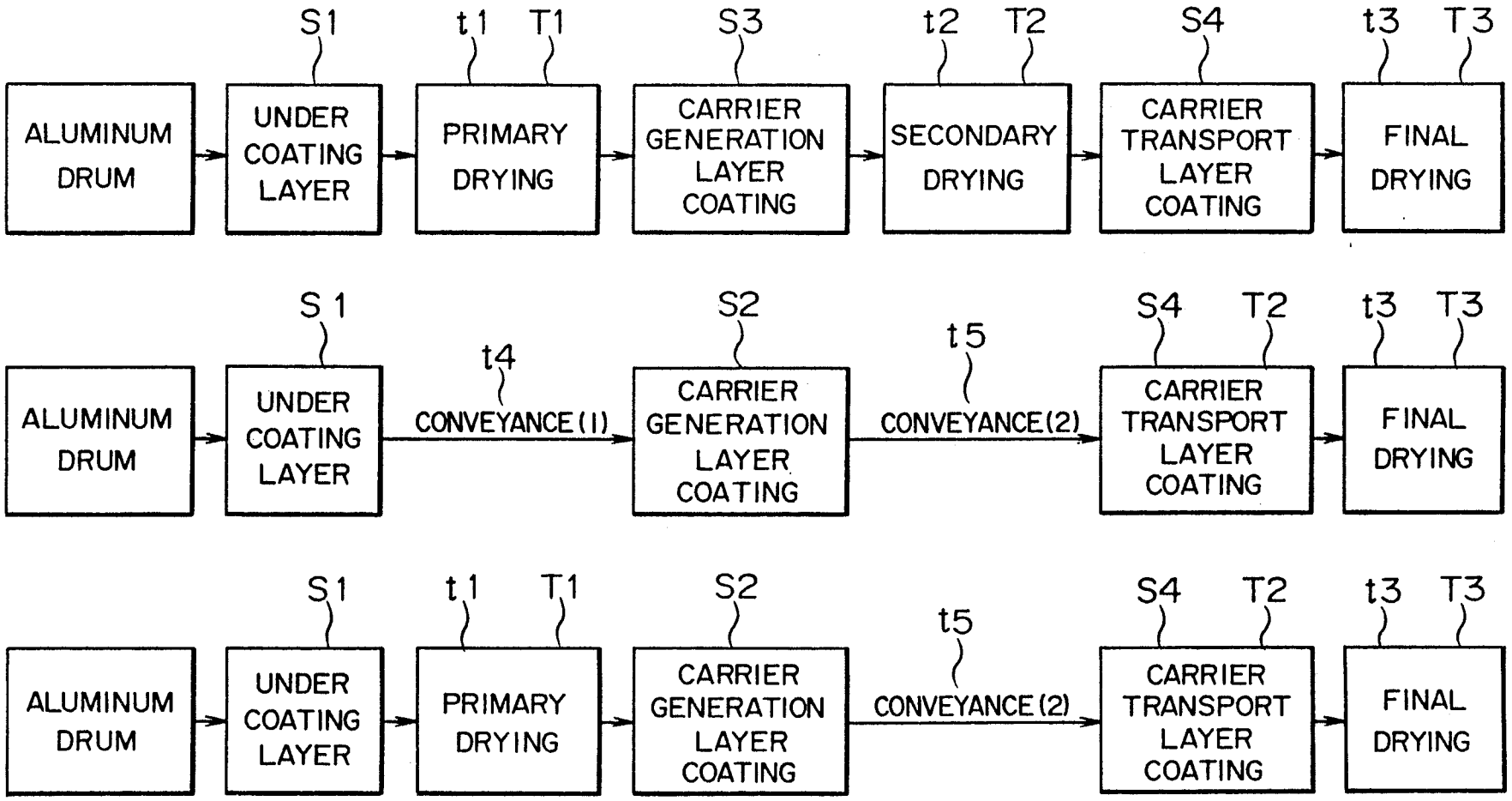
FIG. 2 is a block diagram illustrating the processing steps.
Figure 3:
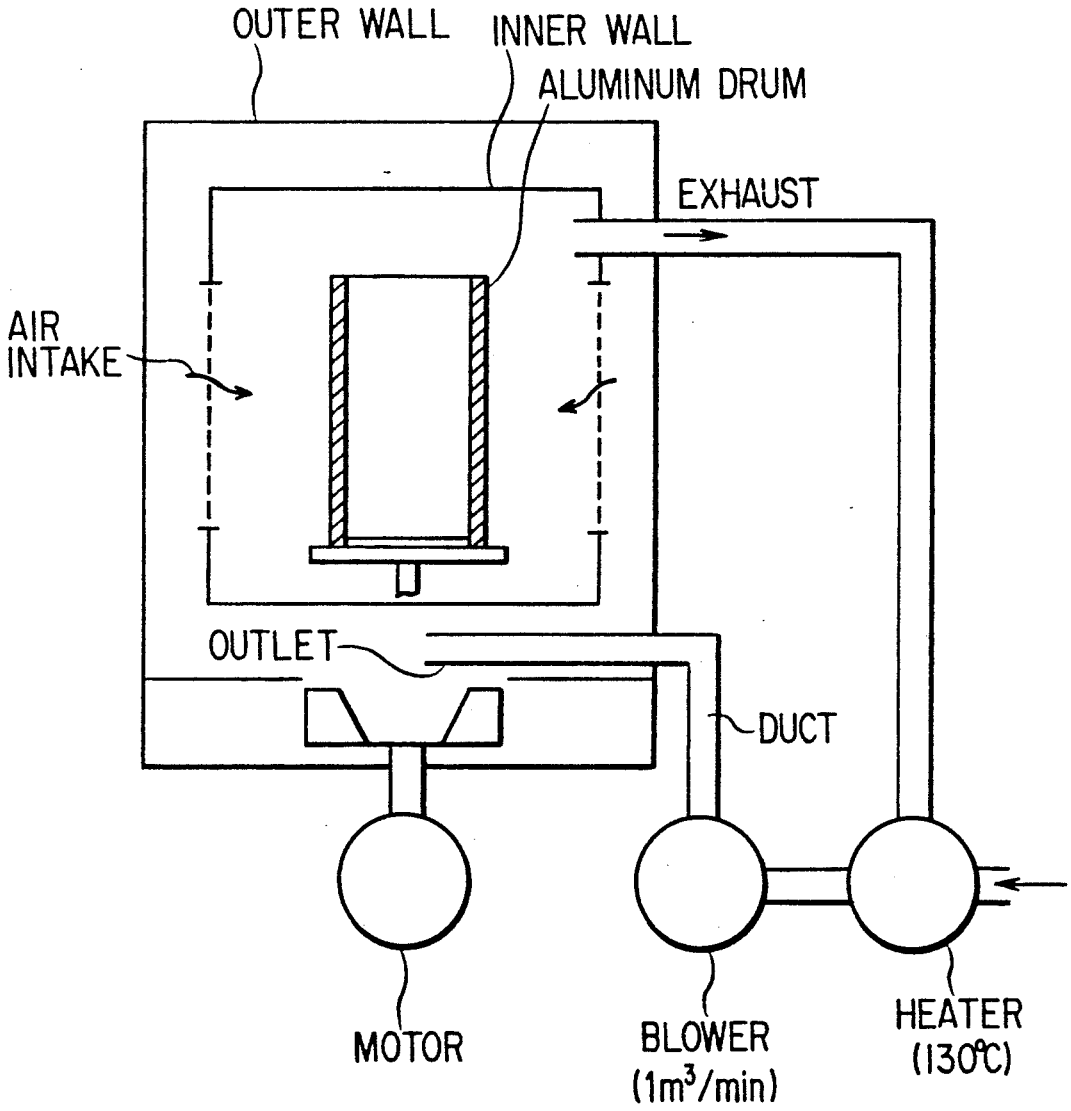
FIG. 3 PRIOR ART

The photoreceptors subject to the tests No. 1 through No. 12 (among which test Nos. 1 to 8 were each for testing the inventive photoreceptors and test Nos. 9 to 12 were each for testing the comparative photoreceptors) could be each prepared by coating thereon with the foregoing coating solutions, respectively, by making use of the resulting substrata and according to block diagrams B1 and B2 for testing the inventive photoreceptors and block diagram B3 for testing the comparative photoreceptors; each of the diagrams shown in FIG. 2, illustrating the steps for preparing photoreceptors.

TABLE 2

| Substratum | | A1 | A2 | A3 | A4 |
|---|---|---|---|---|---|
| Photoreceptor No. | | | | | |
| Preparing step | | | | | |
| For inventive test | B1 | 1 | 2 | 3 | 4 |
| | B2 | 5 | 6 | 7 | 8 |
| For comparative test | B3 | 9 | 10 | 11 | 12 |

The above-mentioned under layer was processed in common in accordance with block diagrams B1, B2 and B3. The washed substrata were each dipped in a coating solution being kept at a temperature of 25° C. under the clean-air atmospheric conditions at 25° C., RH35% and class 100 and pulled up at a pulling-up rate $S_1$ of $S_1=10$ mm/sec., so that the substrata could be so coated as to have a wet-layer thickness of 7 μm. In processing step B1, the substrata were each transported under the foregoing clean-air atmosphere for a transporting time $t_4=10$ minutes after they were each coated, so that an under layer could have a layer thickness of 0.5 μm. The resulting under layer-coated substrata were each transported to the successive carrier generation layer processing step.

In processing steps B2 and B3, the substrata were each coated and were then dried up (i.e., primarily dried up) by hot-air having a drying temperature $T_1=40°$ C. for a drying time $T_1=15$ minutes, so that the substrata were each transported to the successive carrier generation layer processing step.

In each of the processing steps B1, B2 and B3, the carrier generation layer was processed in a coating step under the clean-air atmosphere similar to the case of the above-described under layer. In processing steps B1 and B2, the substrata each having an under layer were dipped in a coating solution being kept at a temperature of 25° C. and were then pulled up at a pulling-up rate of $S_2=8$ mm/sec., so that they were each so coated as to have a wet-layer thickness of 4 μm. In processing step B3, the substrata were each dipped in a coating solution being kept at a temperature of 30° C. and were then pulled up at a pulling-up rate of $S_3=6$ mm/sec., so that they were each so coated as to have a wet-layer thickness of 4 μm.

In processing steps B1 and B2 after completing the coating treatments, a carrier generation layer having a little thicker than 1.0 μm thickness could be obtained upon transporting a substratum under the above-mentioned clean-air atmosphere for a transport time of $t_5=10$ minutes. In processing step B3, a 1.0 μm-thick carrier generation layer could be obtained upon drying it with hot-air having a drying temperature of $T_2=85°$ C. for a drying time of $t_2=30$ minutes and it was then transported to the successive carrier transport layer processing step.

For the layers following the carrier transport layer, B1, B2 and B3 were processed in common processing steps.

A carrier transport layer was coated also in such a manner that a substratum having an under layer and a carrier generation layer was dipped in a coating solution kept at 25° C. under the clean-air atmosphere as same as in coating the under layer and the substratum was pulled up from the coating solution at the pulling-up rate of $S_2=2.5$ mm/sec., so that a coating solution layer having a wet-thickness of 90 μm could be obtained. In each of the processing steps, B1, B2 and B3 shown in FIG. 2, the photoreceptor comprising a photoreceptive layer having a dried-thickness of 20 μm could be prepared by carrying out a predrying of $T_3=70°$ C. for 15 minutes and a principal drying of $T_3=85°$ C. for 45 minutes.

Electrostatic characteristics measurement:

Among the resulting 12 kinds of photoreceptors, the photoreceptors, (Nos. 1, 3, 4, 5, 7, 8, 9, 11 and 12), which were each applied with a substratum having a diameter of 80 mmϕ, A1, A3 and A4, were loaded on U-Bix 2025; and the photoreceptors (Nos. 2, 6 and 10), which were each applied with a substratum A2 having a diameter of 60 mmϕ, were loaded on U-Bix 1515. To the developing position was arranged with a potentiometric probe, an electrostatic meter and a recorder, so that the resulting black-paper potential $V_B$ volt, the white-paper potential $V_W$ volt and dark decay ration 30 seconds after charging D% could be measured. The results thereof are shown in Table 3.

Practical copying test:

Similar to the case of the above-described electrostatic characteristics measurement, the photoreceptors for testing the invention (Nos. 1, 3, 4, 5, 7 and 8) and those for testing the comparison (Nos. 9, 11 and 12) were each loaded on U-Bix 2025, and the photoreceptors for testing the invention (Nos. 2 and 6) and that for testing the comparison (No. 10) was loaded on U-Bix 1515. Each of the image formation was tried by making use of a solid black original under the atmospheric conditions of 20° C. and RH60%, so that the image qualities of the resulting solid black images could be evaluated. The results thereof are shown in Table 3 given below.

TABLE 3

| Test No. (Photoreceptor No.) | Processing test | Substratum | Electrostatic characteristics: Black-paper potential $V_B$ (V) | Dark-decay (%) | White-paper potential $V_W$ (V) | Practical photorecording test: Test machine used | Image quality |
|---|---|---|---|---|---|---|---|
| Invention test | | | | | | | |
| 1 | B1 | A1 | 680 | 22.0 | 70 | U-Bix 2025 | Excellent |
| 2 | B1 | A2 | 650 | 21.9 | 91 | U-Bix 1515 | Excellent |
| 3 | B1 | A3 | 680 | 22.0 | 69 | U-Bix 2025 | Excellent |
| 4 | B1 | A4 | 680 | 22.1 | 70 | U-Bix 2025 | Excellent |
| 5 | B2 | A1 | 680 | 21.8 | 68 | U-Bix 2025 | Excellent |
| 6 | B2 | A2 | 650 | 22.0 | 90 | U-Bix 1515 | Excellent |
| 7 | B2 | A3 | 680 | 22.0 | 70 | U-Bix 2025 | Excellent |
| 8 | B2 | A4 | 680 | 21.0 | 69 | U-Bix 2025 | Excellent |
| Comparison test | | | | | | | |
| 9 | B3 | A1 | 680 | 45.0 | 70 | U-Bix 2025 | Unevenly imaged |
| 10 | B3 | A2 | 650 | 44.8 | 90 | U-Bix 1515 | Unevenly imaged |
| 11 | B3 | A3 | 680 | 45.0 | 69 | U-Bix 2025 | Unevenly imaged |
| 12 | B3 | A4 | 680 | 44.9 | 69 | U-Bix 2025 | Unevenly imaged |

From the results of the electrostatic characteristics and the practical photorecording tests, it could be observed the following facts. In the tests of the invention, not only the electrostatic characteristics could be excellent, but also a high density and sharp image could be obtained without having any image unevennes. In the tests of the comparison, in contrast to the above, the electrostatic characteristics could not be excellent and, in particular, the dark decay was increased and the image density was in low and, in addition, the image unevenness were produced.

As is apparent from the above descriptions, according to the preparation process of the invention, a photoreceptor can be provided so that a high density and sharp image can stably be obtained to have excellent electrophotographic characteristics without having any image unevenness. In addition to the above, the other advantages can also be displayed, for example, the photoreceptor can effectively be prepared with low cost and excellent productivity.

What is claimed is:

1. A process of producing an electrophotographic photoreceptor, the photoreceptor comprising a plurality of layers including a carrier generation layer having a thickness of 0.1 to 2 μm, comprising the steps of:

dipping a substratum into a coating solution to form the carrier generation layer thereon; and conveying the substratum coated with the carrier generation layer under circulating clean air having a cleanness degree of not higher than 100, at a temperature in a range of plus or minus 5 centigrade degrees of the temperature of the coating solution.

2. The process of claim 1 wherein a temperature of the coating solution is less than 30° C., and the temperature of the conveying step is in the range of plus or minus 2° C. of the temperature of the coating solution.

3. The process of claim 2 wherein the temperature of the coating solution is less than 27° C., and the temperature of the conveying step is in the range of plus or minus 2° C. of the temperature of the coating solution.

4. The process of claim 1 wherein an interval of the conveying step is 1 minute to 15 minutes.

5. The process of claim 2 wherein an interval of the conveying step is 1 minute to 15 minutes.

6. The process of claim 3 wherein an interval of the conveying step is 1 minute to 15 minutes.

7. A process of producing an electrophotographic photoreceptor comprising the steps of:

(a) preparing an aluminum drum, (b) coating an under layer on an outer surface of the aluminum drum, (c) conveying the aluminum drum coated with the under layer to a process of coating a carrier generation layer, by a first conveyer, (d) coating the carrier generation layer onto the aluminum drum coated with the under layer by dipping the drum into a carrier generation layer coating solution having a temperature of 5° C. to 27° C. to form a wet layer of 5 to 50 μm, (e) conveying the aluminum drum coated with the layers to a process of coating a carrier transport layer, by a second conveyer, taking 1 to 20 minutes under circulating clean air having a cleaness degree of not higher than 100, and at a temperature of plus or minus 2° C. that of the temperature of the carrier generation layer coating solution, a carrier generation layer having a thickness of 0.1 to 2 μm being formed during conveyance, (f) coating a wet state carrier transport layer of 50 to 100 μm onto the carrier generation layer coated on the aluminum drum, (g) drying the carrier generation layer for 30 to 90 minutes under clean air at a temperature of 80° to 150° C. to form a carrier transport layer of 10 to 30 μm in thickness.

8. The process of claim 1 wherein the conveying step under circulating clean air is for a time interval of 1 to 20 minutes.

* * * * *